US007086488B2

(12) United States Patent
Richman

(10) Patent No.: US 7,086,488 B2
(45) Date of Patent: Aug. 8, 2006

(54) CUTTING ELEMENT HAVING ENHANCED CUTTING GEOMETRY

(75) Inventor: Lance T. Richman, Ponca City, OK (US)

(73) Assignee: Smith International, Inc., Houston, TX (US)

( * ) Notice: Subject to any disclaimer, the term of this patent is extended or adjusted under 35 U.S.C. 154(b) by 100 days.

(21) Appl. No.: 10/636,301

(22) Filed: Aug. 6, 2003

(65) Prior Publication Data

US 2004/0084223 A1 May 6, 2004

Related U.S. Application Data

(60) Provisional application No. 60/423,561, filed on Nov. 4, 2002.

(51) Int. Cl.
*E21B 10/16* (2006.01)

(52) U.S. Cl. ..... 175/374; 175/426

(58) Field of Classification Search ..... 175/374, 175/426

See application file for complete search history.

(56) References Cited

U.S. PATENT DOCUMENTS 4,058,177 A * 11/1977 Langford et al. ..... 175/374
4,334,586 A * 6/1982 Schumacher ..... 175/374
4,343,371 A * 8/1982 Baker et al. ..... 175/430
4,811,801 A * 3/1989 Salesky et al. ..... 175/433
5,172,777 A * 12/1992 Siracki et al. ..... 175/374
5,881,828 A * 3/1999 Fischer et al. ..... 175/374
6,145,605 A * 11/2000 Karlsson ..... 175/331
6,290,008 B1 * 9/2001 Portwood et al. ..... 175/426
6,460,637 B1 * 10/2002 Siracki et al. ..... 175/430
6,604,588 B1 * 8/2003 Eyre et al. ..... 175/374

OTHER PUBLICATIONS

Official Action issued in corresponding Canadian Appl. No. 2,447,747; Dated Feb. 3, 2006; 2 pages.

* cited by examiner

*Primary Examiner*—Hoang Dang
(74) *Attorney, Agent, or Firm*—Osha Liang LLP

(57) ABSTRACT

A drill bit that includes a bit body, at least one roller cone attached to the bit body and able to rotate with respect to the bit body, a plurality of cutting elements disposed on the at least one roller cone, and a barrel axis is disclosed. At least one of the plurality of cutting elements includes a first area defining a secondary wear surface, wherein the first area is formed as a convex surface on the trailing edge, a second area proximate the first area defining a main wear surface, wherein the second area is formed as a convex curved surface having a radius of curvature substantially equal to a radius of a borehole, and a third area defining a spherical cutting surface. Further, at least one of the plurality of cutting elements includes a non-spherical transition zone disposed between the third area and the first and second areas, wherein the barrel axis intersects the transition zone.

27 Claims, 4 Drawing Sheets

CUTTING ELEMENT HAVING ENHANCED CUTTING GEOMETRY

CROSS-REFERENCE TO RELATED APPLICATIONS

This application claims priority to U.S. Provisional Application No. 60/423,561 filed on Nov. 4, 2002. That application is incorporated by reference in its entirety.

BACKGROUND OF INVENTION

1. Field of the Invention

The invention relates generally to roller cone drill bits for drilling earth formations, and more specifically to the geometry of cutting elements on roller cone drill bits.

2. Background Art

FIG. 1 shows one example of a roller cone drill bit used in a conventional drilling system for drilling a well bore in an earth formation. The drilling system includes a drilling rig 100 used to turn a drill string 120 which extends downward into a well bore 140. Connected to the end of the drill string 120 is roller cone-type drill bit 200.

In roller cone bits, the cutting elements drill the earth formation by a combination of compressive fracturing and shearing action. Prior art milled tooth bits typically have teeth formed from steel or other easily machinable high-strength material, to which a hardface overlay such as tungsten carbide or other wear resistant material is often applied. The hardfacing is applied by any one of a number of well known methods. There are a number of references which describe specialized exterior surface shapes for the substrate.

The specialized shapes are intended to provide a cutting structure which includes more thickness of hardface overlay in wear-prone areas, so that the useful life of the teeth can be increased. Examples of such specialized substrate shapes are shown in U.S. Pat. Nos. 5,791,423, 5,351,771, 5,351,769, and 5,152,194, for example. These references show that the teeth have substantially regular trapezoidal exterior hardface surfaces. The irregular shape of the substrate outer surface is selected to provide additional hardface in the wear prone areas while maintaining a conventional exterior tooth surface.

U.S. Pat. No. 6,029,759 issued to Sue et al shows a milled tooth drill bit having teeth in a gage row (the outermost row of teeth on any cone used to maintain full drilling diameter), wherein the teeth have a particular outer surface. See for example FIG. 12B in Sue et al '759. The particular outer surface of these teeth is intended to make it easier to apply hardfacing in two layers, using two different materials. The purpose of such tooth structures is to have selected hardfacing materials positioned to correspond to the level of expected wear on the various positions about the outer surface of the tooth.

Polycrystalline diamond ("PCD") enhanced inserts and tungsten carbide ("WC—Co") inserts are two commonly used inserts for roller cone rock bits and hammer bits. A roller cone rock bit typically includes a bit body adapted to be coupled to a rotatable drill string and include at least one "cone" that is rotatably mounted to the bit body. The cone typically has a plurality of inserts pressed into it. The inserts contact with the formation during drilling.

The PCD layer on PCD enhanced inserts is extremely hard. As a result, the PCD layer has excellent wear resistance properties. While the actual hardness of the PCD layer varies for the inserts used in particular bit types, each type of PCD has a common failure mode of chipping and spalling due to cyclical impact loading on the inserts during drilling. Conversely, the softer, tougher tungsten carbide inserts tend to fail by excessive wear and not by chipping and spalling. Therefore a need exists for inserts for roller cone bits that are optimized for resisting both wear and impact as encountered during drilling.

SUMMARY OF INVENTION

In one aspect, the present invention relates to a drill bit that includes a bit body, at least one roller cone attached to the bit body and able to rotate with respect to the bit body, and a plurality of cutting elements disposed on the at least one roller cone, at least one of the plurality of cutting elements comprising a first area defining a trailing edge, and a second area proximate the first area defining a main wear surface, wherein, in a preferred embodiment, a surface of the second area is a curved surface having a radius of curvature substantially equal to a radius of a borehole.

In another aspect, the present invention relates to a drill bit that includes a bit body, at least one roller cone attached to the bit body and able to rotate with respect to the bit body, and a plurality of cutting elements disposed on the at least one roller cone, at least one of the plurality of cutting elements comprising a first area defining a trailing edge, a second area proximate the first area defining a main wear surface, a third area defining a spherical cutting surface that interacts with a hole bottom, and a transition zone, wherein the transition zone is disposed between the first, second, and third areas.

In another aspect, the present invention relates to an insert for a drill bit that includes a contact portion adapted to contact an earth formation, the contact portion further comprising a first area defining a relieved trailing edge, and a second area defining a main wear surface, wherein a surface of the second area is a curved surface having a radius of curvature substantially equal to a radius of a borehole.

Other aspects and advantages of the invention will be apparent from the following description and the appended claims.

DETAILED DESCRIPTION

The present invention relates to an improved geometry for cutting elements used in roller cone drill bits. In particular, certain embodiments relate to an insert having an optimized shape for rotary drilling mechanics. As used herein, the term "cutting element," is used to generically refer to different types of teeth used on bits (e.g., milled teeth and inserts).

Figure 1:
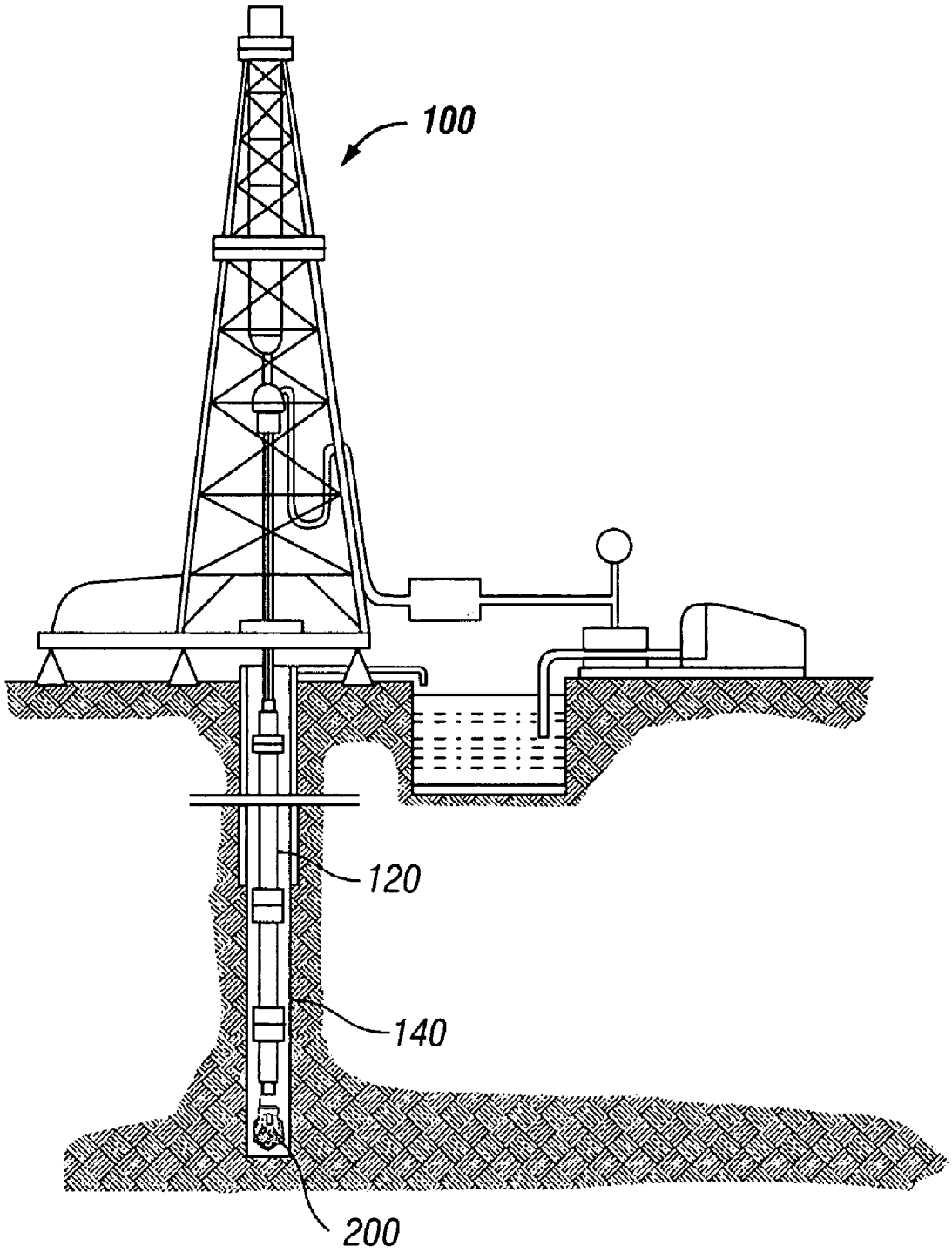
FIG. 1 (Prior Art)
FIG. 1 shows a schematic diagram of a drilling system for drilling earth formations having a drill string attached at one end to a roller cone drill bit.
Figure 2:
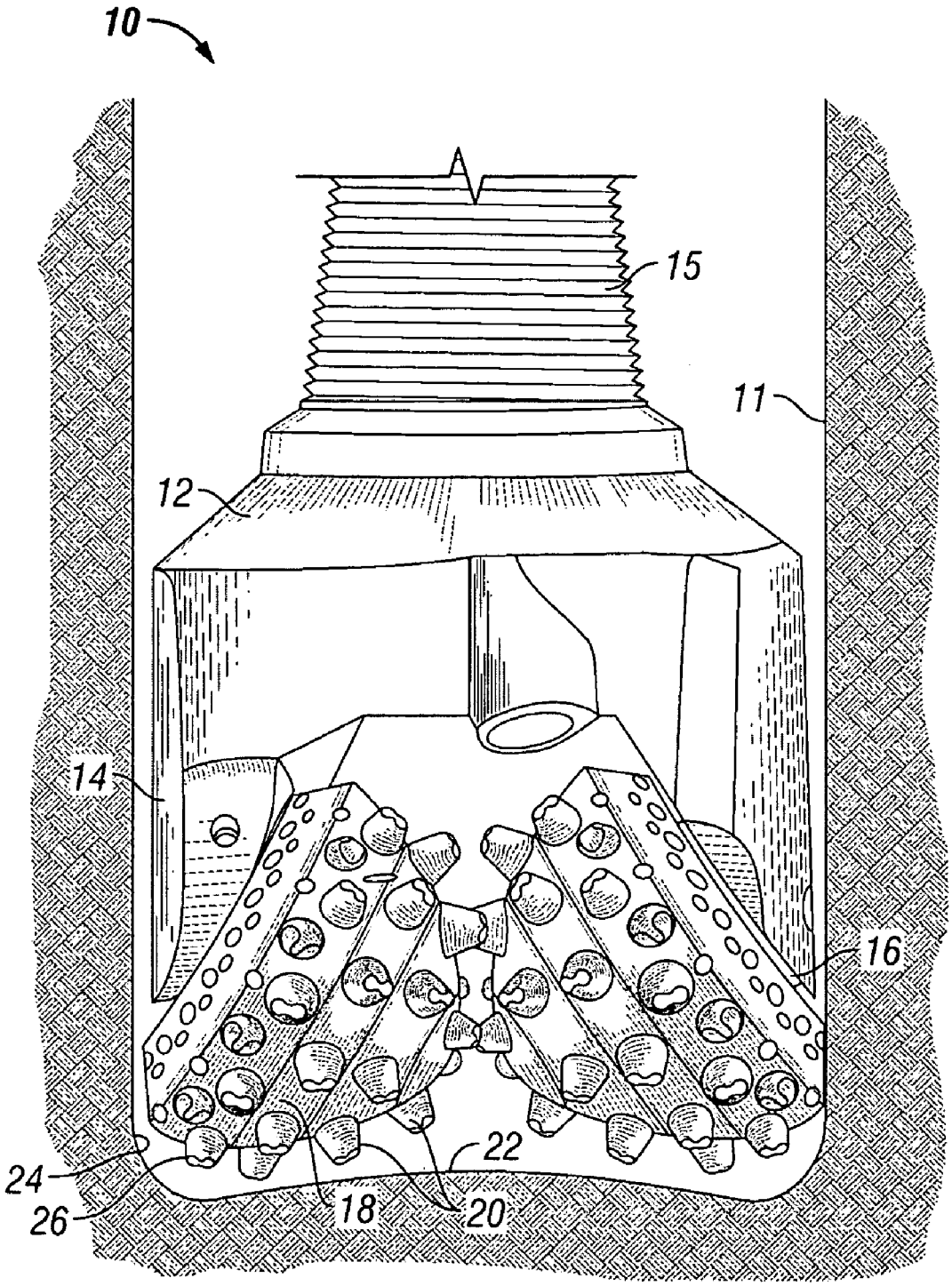
FIG. 2 shows a roller cone bit having inserts in accordance with an embodiment of the present invention.
Figure 3:
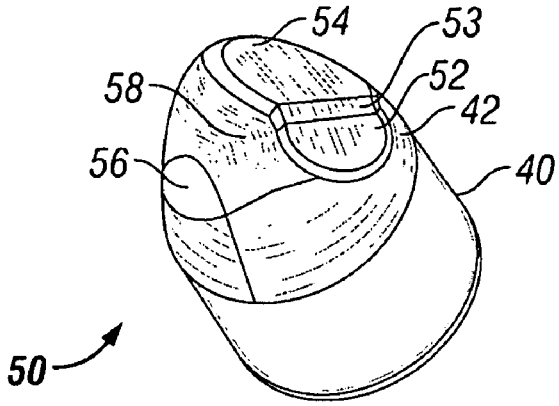
FIG. 3 shows an exploded view of an insert formed in accordance with an embodiment of the present invention.
Figure 4A:
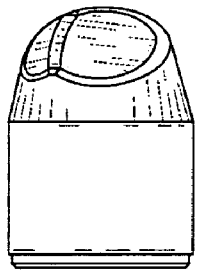
FIGS. 4*a*–4*d* show various side and top views of an insert formed in accordance with an embodiment of the present invention.
Figure 4B:
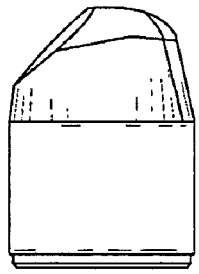
Figure 4C:
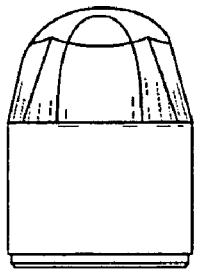
Figure 4D:
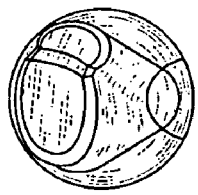

Referring to FIG. 2, a roller cone rock bit 10 according to the preferred roller cone bit embodiment of the present invention, is shown disposed in a borehole 11. The bit 10 has a body 12 with legs 14 extending generally downward, and a threaded pin end 15 opposite thereto for attachment to a drill string (not shown). Journal shafts 16 are cantilevered from legs 14. Rolling cutters (or roller cones) 18 are rotatably mounted on the journal shafts 16. Each cutter 18 has a plurality of inserts 20 mounted thereon.

As the body 12 is rotated by rotation of the drill string (not shown), the cutters 18 rotate over the borehole bottom 22 and maintain the gage of the borehole by rotating against a portion of the borehole sidewall 24. As the cutter 18 rotates, individual inserts are rotated into contact with the formation and then out of contact with the formation. As a result, the inserts undergo cyclical loading which can contribute to fatigue failure. Inserts 26 are called "gage" inserts because they contact, at least partially, the sidewall 24 to maintain the gage of the borehole 11. All of the inserts, and particularly gage inserts 26, undergo repeated impact loading as they are rotated into and out of contact with the earth formation. In the present invention, at least one insert on the roller cone rock bit 10 has an improved cutting structure, as described below.

In different embodiments, inserts designed in accordance with the present invention may comprise a composite PCD material. Preferably for a roller cone bit application, the insert has a hardness of between about 1000 to 3000 Vickers Hardness Units (HV). This hardness provides a resulting increase in impact resistance that is beneficial for inserts used in roller cone drill bits, while not significantly sacrificing wear resistance. However, inserts having hardnesses well outside this range may be used.

In other embodiments, inserts designed in accordance with the present invention may comprise tungsten carbide inserts. One of ordinary skill in the art will recognize that the type of insert material is not as significant as the improved geometries of the insert, described below. Accordingly, it is expressly within the scope of the present invention that various compositions (be it boron-nitride containing, tungsten-carbide containing, PCD, etc. inserts) may be used with the below described geometry.

Referring to FIGS. 3 and 4*a*–4*d*, one embodiment of an insert 50 according to the present invention is shown. The insert 50 may be used as any one of the inserts on a cutter but has particular application as a gage insert. Accordingly, the following description is made in reference to insert 50 being a gage insert. Insert 50 comprises a substrate having a grip portion 40 and an extension portion 42. The grip portion 40 is sized for a press fit within sockets formed in rolling cutters (18 in FIG. 2). The extension portion has a outer layer (not shown) that contacts the borehole (not shown), which is referred to as the contact surface (not separately numbered). In this particular embodiment, the contact surface comprises first, second, and third "enhanced" areas that improve the rate of penetration and/or the life of the insert.

The first area 52 comprises a convex relief located on the trailing edge of the insert 50. This first area 52 acts as a secondary wear surface and is used to reduce the wear rate as well as heat generation due to the insert 50 dragging on the bore sidewall as it exits the formation. By removing material from the trailing edge on the insert 50 (to form the first area 52), a relieved surface is formed and therefore, eliminates what would otherwise be an unsupported extension that could lead to insert breakage. Thus the relief area reduces the stress' on the trailing side of the insert as it exits the hole wall in a sheering motion.

The second area 54 acts as a main wear surface for the insert 50. This main wear surface is important to reduce the rate at which the insert wears or erodes away. Notably, the second area 54 is not flat, but rather, in the preferred embodiment, has a large radius (L) similar to that of the hole being drilled, in order to increase the surface area of the insert that makes contact with the bore wall. One of ordinary skill in the art will appreciate that depending on the size of the, bit, drill string, insert, etc., the size of the radius L will vary. However, the actual size of the radius is not significant, instead, in the preferred embodiment, providing a radius of curvature approximate to the radius of the borehole is the significant step.

As noted above, in the preferred embodiment, the insert has a radius of curvature substantially similar to the radius of the borehole being drilled. However, it is expressly within the scope of the present invention that the radii can vary by as much as 100%. Further, while the main wear surface has been described as a convex surface, in some embodiments, the main wear surface is a planar surface.

By, providing a convex surface having a relatively large diameter, the second area 54 distributes wear over a larger area of the insert, decreasing the amount of wear that any one particular portion of the insert is subjected to. Furthermore, decreasing stress on the insert results in a decreased chance of insert breakage.

Furthermore, in certain embodiments, a third area 56 is disposed on the insert 50. In a preferred embodiment, the third area 56 is a spherical cutting surface adapted to penetrate the hole bottom. Accordingly, while the first and second areas (52 and 54, respectively), are scraping the hole sidewall, the third area 56 is scraping the hole bottom, and removing formation. A transition zone 58, located between the third area 56 and the first and second areas (52,54) is significant because it forms a wedge shape. This wedge shape (formed from the geometry of the three areas) helps to increase the size of rock fracture. In a preferred embodiment, the transition zone 58 is slightly bowed outward in order to maximize carbide volume and reduce insert stress.

This wedge shape, located, in this embodiment, between the third surface and the other two enhanced surfaces, represents a significant improvement over typical prior art inserts. In particular, embodiments of the present invention provide the wedge shape in a plane nearly perpendicular to the insert barrel axis. Typical chisel inserts have a wedge shape in a plane that passes through the axis of the insert barrel. It has been discovered that additional advantages, such as those described above, result from the geometry of the present invention. While the "wedge-shaped" transition zone has been described in reference to an embodiment where three enhanced surfaces are present, the transition zone may be used in embodiments having more or less.

What is significant, however, is the overall shape and relative orientation of the transition zone. As described above, preferably, the transition zone has an overall wedge shape and is disposed such that the wedge is perpendicular to a barrel axis of the chisel. One of ordinary skill in the art, having reference to this disclosure, would understand the variations that fall within this general description.

Figure 5:
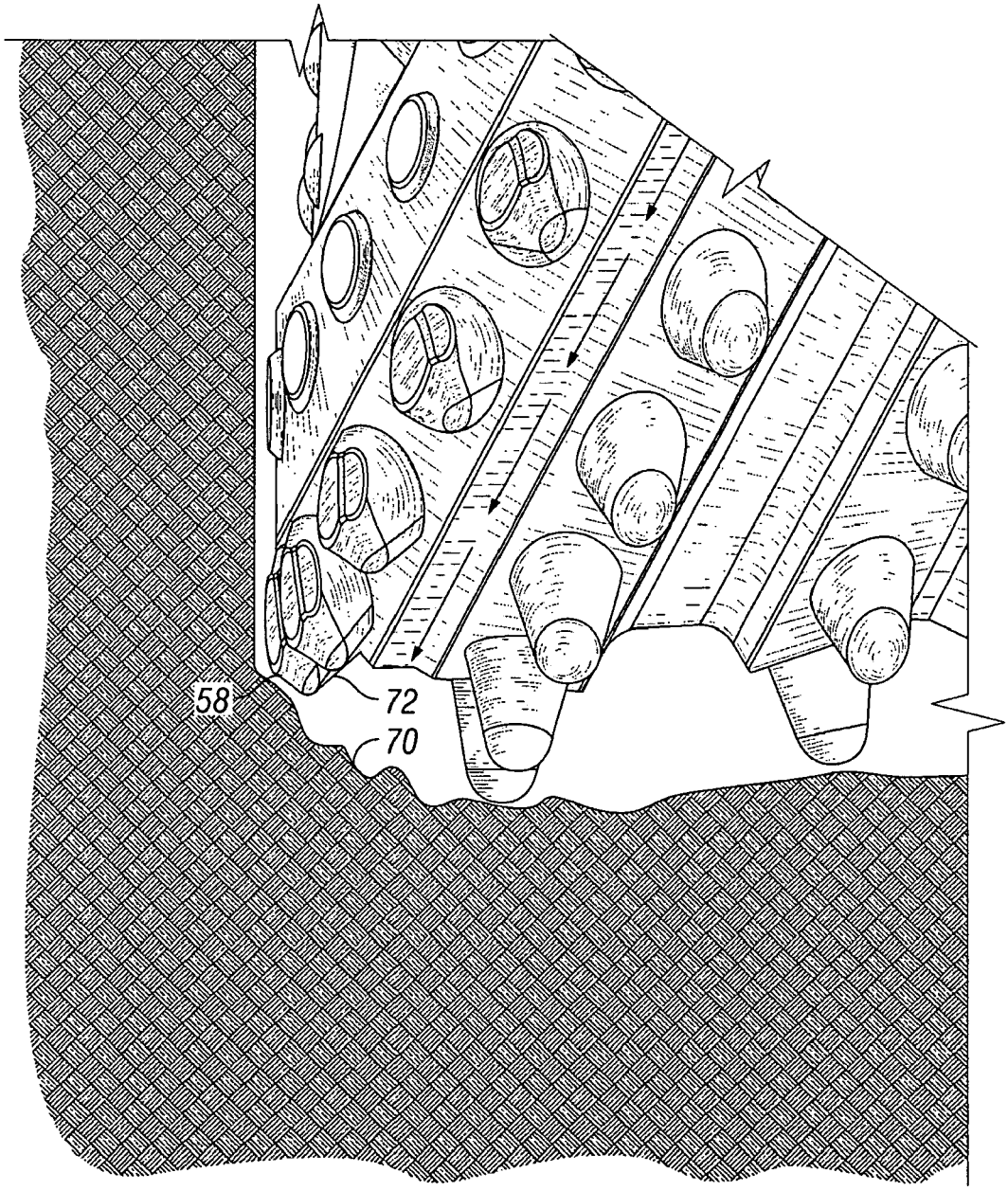
FIG. 5 shows inserts designed in accordance with one embodiment of the present invention disposed on a gage row.

FIG. 5 shows one embodiment of inserts designed in accordance with embodiments of the present interacting with a borehole 70. In FIG. 5, a gage insert 72, is shown contacting a sidewall (not separately numbered) of the borehole 70. From this figure, the interaction of the insert 72 with the sidewall 70 may be understood. Further, while this figure shows enhanced geometry inserts disposed on a gage row of a roller cone, it is expressly within the scope of the present invention that cutting elements (whether insert or milled tooth) having the improved geometry may be disposed in any fashion on the roller cone or cones.

Further, FIG. 5 shows transition zone 58 contacting the borehole 70. From this figure, the overall "wedge-shape" of the transition zone 58 is clearly seen. As shown in this embodiment, the transition zone 58 is disposed such that the transition zone 58 is in a plane substantially perpendicular to a barrel axis of the gage insert 72. This is a distinct difference as compared with prior art inserts, which have "wedge-shaped" portions disposed in a plane substantially parallel to the barrel axis of the gage insert.

It should also be clearly understood that while the invention is described herein with reference to bits having cutting elements which are inserts made from hard material, such as tungsten carbide, and/or superhard material, such as diamond or cubic boron nitride, the shape of the exterior surface of selected cutting elements on a drill bit according to the invention is not limited to insert bits. Other roller cone bits known in the art, including those having cutting elements which are made from milled teeth having a hardfacing layer disposed thereon, are also within the scope of this invention.

It should also be noted that while the embodiments of the invention shown herein are described as being used with a bit having three roller cones, embodiments of the invention may include drill bits having any number of roller cones.

In one or more embodiments of the present invention, a cutting element in accordance with embodiments of the present invention advantageously provides an improved rate of penetration, reduction of wear, and/or increases the amount of formation cut with each rotation of the cone. Moreover, in one more embodiments having three areas, as discussed above, the resultant wedge shape formed between the three areas increases the amount of rock fractured as compared to the prior art. In addition, because of the reduced stresses on the insert, harder carbide grades may be used.

The use of these harder grades of tungsten carbide further slows the insert wear rate. Accordingly, it is expressly within the scope of the present invention that any hardness range may be used. One of ordinary skill in the art, having reference to this disclosure, will recognize that the various properties of an insert in accordance with the present invention may be tailored, depending on the particular formation being drilled.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body;

at least one roller cone attached to the bit body and able to rotate with respect to the bit body; and a plurality of cutting elements disposed on the at least one roller cone, at least one of the plurality of cutting elements comprising:

a barrel axis;

a first area defining a secondary wear surface, wherein the first area is formed as a convex surface on a trailing edge of the at least one cutting element;

a second area proximate the first area and defining a main wear surface, wherein the second area is formed as a convex curved surface having a radius of curvature substantially equal to a radius of a borehole;

a third area defining a spherical cutting surface; and a non-spherical transition zone disposed between the third area and the first and second areas, wherein the barrel axis intersects the transition zone.

2. The drill bit of claim 1, wherein the spherical cutting surface is arranged to interact with a bottom surface of a borehole.

3. The drill bit of claim 1, wherein the transition zone defines a wedge-shaped surface.

4. The drill bit of claim 1, wherein the transition zone lies in a plane substantially perpendicular to the barrel axis of the at least one cutting element.

5. The drill bit of claim 1, wherein the transition zone is bowed slightly outward from the at least one cutting element.

6. The drill bit of claim 1, wherein the first area defines a relief area.

7. The drill bit of claim 1, wherein the at least one cutting element comprises a composite PCD material.

8. The drill bit of claim 1, wherein the at least one cutting element has a hardness of about 1000 to 3000 Vickers Hardness Units.

9. The drill bit of claim 1, wherein the at least one cutting element comprises a tungsten carbide material.

10. The drill bit of claim 1, wherein the first area and the second area are arranged to interact with a sidewall of a borehole.

11. A drill bit, comprising:

a bit body;

at least one roller cone attached to the bit body and able to rotate with respect to the bit body;

at least one gage insert attached to the roller cone and comprising a barrel axis and a contact portion adapted to contact an earth formation, the contact portion comprising:

a first area defining a relieved trailing edge;

a second area defining a main wear surface formed proximate to the first area, wherein the second area is a convex curved surface having a radius of curvature substantially equal to a radius of a borehole;

a third area defining a spherical cutting surface; and a transition zone defining a wedge-shaped surface formed between the third area and the first and second areas, wherein the barrel axis intersects the wedge-shaped surface of the transition zone.

12. The drill bit of claim 11, wherein the first area is a convex surface.

13. The drill bit of claim 11, wherein the transition zone lies in a plane substantially perpendicular to the barrel axis of the gage insert.

14. The drill bit of claim 11, wherein the transition zone is slightly bowed out from a surface of the gage insert.

15. The drill bit of claim 11, wherein the third area is arranged to interact with a bottom surface of a borehole.

16. The drill bit of claim 11, wherein the first area and the second area are arranged to interact with a sidewall of a borehole.

17. The drill bit of claim 11, wherein the gage insert further comprises a grip portion sized to press fit within a socked formed in a surface of the roller cone.

18. An insert for a drill bit comprising:

a barrel axis;

a contact portion adapted to contact an earth formation, the contact portion comprising:

a first area defining a relieved trailing edge;

a second area proximate to the first area and defining a main wear surface, wherein a surface of the second area is a convex curved surface having a radius of curvature substantially equal to a radius of a borehole;

a third area defining a spherical cutting surface;

a non-spherical transition zone disposed between the third area and the first and second areas, wherein the transition zone intersects the barrel axis.

19. The insert of claim 18, wherein the third area is arranged to interact with a bottom surface of a borehole.

20. The insert of claim 18, wherein the transition zone lies in a plane substantially perpendicular to the barrel axis of the insert.

21. The insert of claim 20, wherein a surface of the transition zone is a wedge-shaped surface bowed slightly out from the contact portion.

22. The insert of claim 18, wherein a surface of the first area is a convex surface.

23. The insert of claim 18, wherein the first area and the second area are arranged to interact with a sidewall of a borehole.

24. The insert of claim 18, further comprising a grip portion adapted to engage with a roller cone.

25. The insert of claim 18, wherein the insert comprises a composite PCD material.

26. The insert of claim 18, wherein the insert has a hardness of about 1000 to 3000 Vickers Hardness Units.

27. The insert of claim 18, wherein the insert comprises a tungsten carbide material.

* * * * *